US011046094B2

(12) United States Patent
Mizawa

(10) Patent No.: US 11,046,094 B2
(45) Date of Patent: Jun. 29, 2021

(54) LIQUID DISCHARGE APPARATUS AND METHOD THEREOF

(71) Applicant: Junichi Mizawa, Kanagawa (JP)

(72) Inventor: Junichi Mizawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/782,731

(22) Filed: Feb. 5, 2020

(65) Prior Publication Data

US 2020/0269605 A1 Aug. 27, 2020

(30) Foreign Application Priority Data

Feb. 22, 2019 (JP) ..... JP2019-030771

(51) Int. Cl.
*B41J 11/00* (2006.01)
*B41J 2/165* (2006.01)

(52) U.S. Cl.
CPC ..... *B41J 11/002* (2013.01); *B41J 2/16508* (2013.01); *B41J 2/16517* (2013.01); *B41J 2/16526* (2013.01)

(58) Field of Classification Search
CPC .. B41J 11/002; B41J 2/16526; B41J 2/16508; B41J 2/16517
USPC ..... 347/9–11, 37, 102
See application file for complete search history.

(56) References Cited

U.S. PATENT DOCUMENTS

| | | | | |
|---|---|---|---|---|
| 7,806,508 | B2 * | 10/2010 | Hirato | B41J 11/002 347/35 |
| 8,740,349 | B2 * | 6/2014 | Takano | B41J 2/185 347/37 |
| 10,703,113 | B2 * | 7/2020 | Matsuki | H05B 45/00 |
| 2012/0162315 | A1 | 6/2012 | Takano et al. | |
| 2018/0207956 | A1 * | 7/2018 | Mezaki | B41J 25/3082 |
| 2019/0275810 | A1 | 9/2019 | Matsuki et al. | |

FOREIGN PATENT DOCUMENTS

| | | |
|---|---|---|
| JP | 2000-280488 | 10/2000 |
| JP | 2011-031427 | 2/2011 |
| JP | 2011-093194 | 5/2011 |
| JP | 2012-139829 | 7/2012 |

* cited by examiner

*Primary Examiner* — An H Do
(74) *Attorney, Agent, or Firm* — Duft & Bornsen, PC

(57) ABSTRACT

A liquid discharge apparatus includes a liquid discharge head configured to discharge a liquid onto a medium, a carriage mounting the liquid discharge head configured to move the liquid discharge head in a main scanning direction, a dummy-discharge receptacle to receive a dummy-discharge liquid discharged from the liquid discharge head in a dummy-discharge operation, a light irradiator to irradiate the dummy-discharge liquid in the dummy-discharge receptacle with a light, and circuitry. The circuitry sets a plurality of dummy-discharge areas virtually dividing an interior of the dummy-discharge receptacle, moves the carriage in the main scanning direction to a first dummy-discharge area among the plurality of dummy-discharge areas, drives the liquid discharge head to discharge the dummy-discharge liquid onto the first dummy-discharge area in the dummy-discharge receptacle, and irradiates the dummy-discharge liquid in the first dummy-discharge area in the dummy-discharge receptacle with the light.

18 Claims, 11 Drawing Sheets

LIQUID DISCHARGE APPARATUS AND METHOD THEREOF

CROSS-REFERENCE TO RELATED APPLICATION

This patent application is based on and claims priority pursuant to 35 U.S.C. § 119(a) to Japanese Patent Application No. 2019-030771, filed on Feb. 22, 2019 in the Japan Patent Office, the entire disclosures of which is hereby incorporated by reference herein.

BACKGROUND

Technical Field

Aspects of the present disclosure relate to a liquid discharge apparatus and a method thereof.

Related Art

A liquid discharge apparatus includes a liquid discharge head to discharge a liquid onto a medium. The liquid discharge apparatus discharges the liquid from the liquid discharge head while scanning the liquid discharge head. A liquid to be discharged from the liquid discharge head includes a curable liquid having a property of being cured by irradiation of light of a specific wavelength. The liquid discharge apparatus that discharges the curable liquid includes a light irradiator that irradiates the curable liquid discharged onto the medium with the light such as ultraviolet rays.

The liquid discharge apparatus periodically performs a maintenance operation (maintenance recovery operation) to ensure the liquid discharge head continues to stably discharge. The maintenance operation prevents clogging of a nozzle of the liquid discharge head and stabilizes a state of liquid discharge of the liquid discharge head. In the maintenance operation, the liquid discharge apparatus performs a discharge operation (dummy-discharge operation) at a position different from a position at which the medium is placed. The liquid discharge apparatus includes a container (dummy-discharge receptacle) at a position at which the dummy-discharge operation is performed. The dummy-discharge receptacle collects the liquid discharged by the dummy-discharge operation. The dummy-discharge receptacle may collect the curable liquid.

SUMMARY

In an aspect of this disclosure, a novel liquid discharge apparatus is described that includes a liquid discharge head configured to discharge a liquid onto a medium, a carriage mounting the liquid discharge head configured to move the liquid discharge head in a main scanning direction, a dummy-discharge receptacle to receive a dummy-discharge liquid discharged from the liquid discharge head in a dummy-discharge operation, a light irradiator to irradiate the dummy-discharge liquid in the dummy-discharge receptacle with a light and circuitry. The circuitry sets a plurality of dummy-discharge areas virtually dividing an interior of the dummy-discharge receptacle, moves the carriage in the main-scanning direction to a first dummy-discharge area among the plurality of dummy-discharge areas, drives the liquid discharge head to discharge the dummy-discharge liquid onto the first dummy-discharge area in the dummy-discharge receptacle, irradiates the dummy-discharge liquid in the first dummy-discharge area in the dummy-discharge receptacle with the light, determines whether a number of dummy-discharge operations exceeds a threshold value, and moves the carriage to a second dummy-discharge area different from the first dummy-discharge area among the plurality of dummy-discharge areas if the number of dummy-discharge operations exceeds the threshold value.

In another aspect of this disclosure, a novel method of performing a dummy-discharge operation in a liquid discharge apparatus is described. The method includes setting a plurality of dummy-discharge areas virtually dividing an interior of a dummy-discharge receptacle, moving a carriage in a main scanning direction to a first dummy-discharge area among the plurality of dummy-discharge areas, driving a liquid discharge head to discharge a dummy-discharge liquid onto the first dummy-discharge area in the dummy-discharge receptacle, irradiating the dummy-discharge liquid in the first dummy-discharge area in the dummy-discharge receptacle with a light, determining whether a number of dummy-discharge operations exceeds a threshold value, and moving the carriage to a second dummy-discharge area different from the first dummy-discharge area among the plurality of dummy-discharge areas if the number of dummy-discharge operations exceeds the threshold value.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
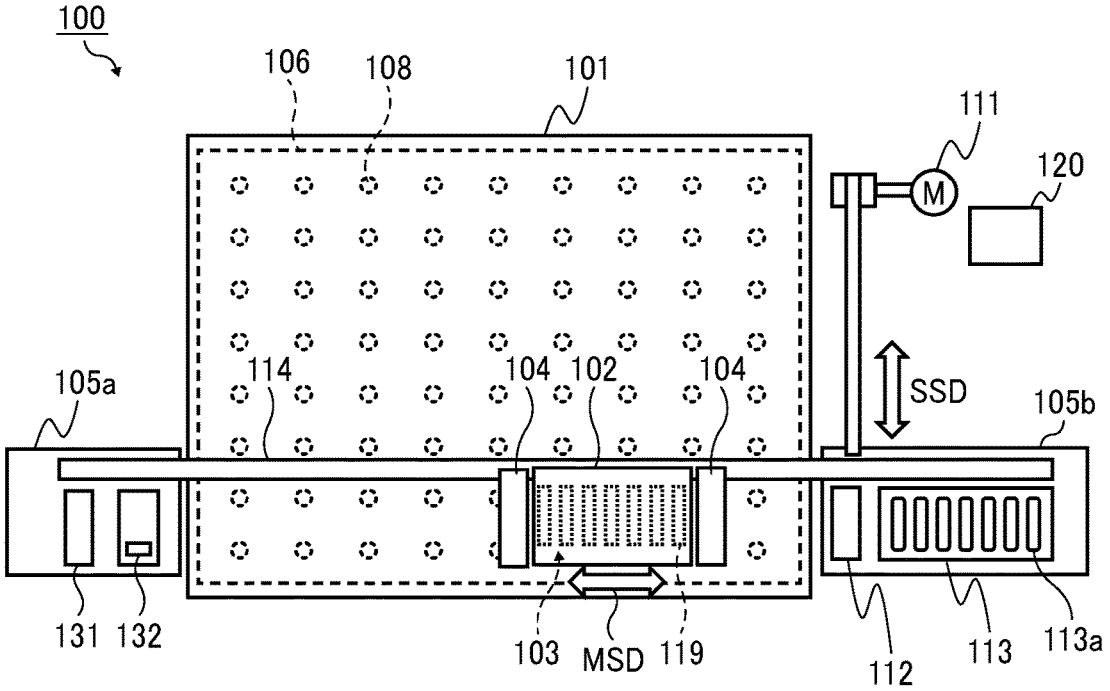
FIG. 1 is a schematic plan view of a main part of a printer as an embodiment of a liquid discharge apparatus according to the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of a liquid discharge apparatus according to the present embodiment is described with reference to the drawings. The liquid discharge apparatus according to the present embodiment discharges a curable liquid having a property of being cured by irradiation of a light (curing ray) having a specific wavelength. The liquid discharge apparatus has a characteristic of periodically performing a dummy-discharge operation to maintain an operation of the liquid discharge head and to recover a state of operation of the liquid discharge head. The liquid discharge apparatus further has a characteristic in a process of collecting the curable liquid discharged during the dummy-discharge operation.

[Structure of Liquid Discharge Apparatus]

Figure 2:
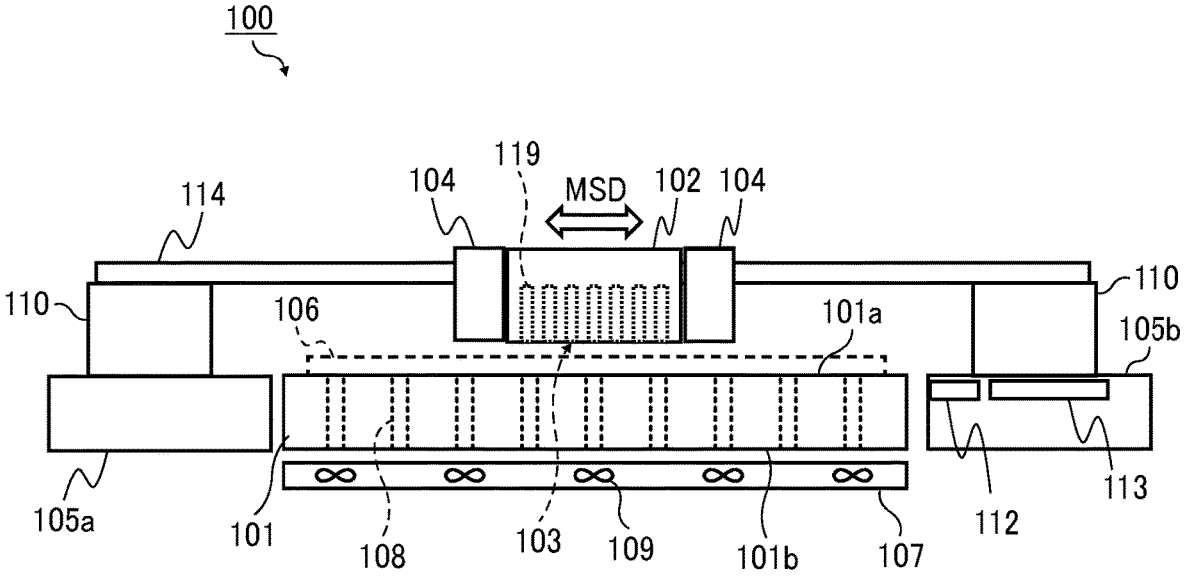
FIG. 2 is a schematic front view of the main part of the printer.

FIG. 1 is a schematic plan view of an example of a configuration of a printer 100 as an embodiment of a liquid discharge apparatus. FIG. 2 is a schematic front view of an example of a configuration of the printer 100. A schematic configuration of the printer 100 is described with reference to FIGS. 1 and 2.

The printer 100 includes a stage 101, a carriage 102, a head device 103, a light irradiator 104, maintenance units 105*a* and 105*b*, a drive motor 111, a dummy-discharge receptacle 112, a capping unit 113, a carriage stay 114, a controller (circuitry) 120, and the like.

The controller 120 includes a computer that performs arithmetic processing to control all operations of the printer 100, for example. Details of the controller 120 are given below.

The stage 101 includes a mounting surface on which a medium used for image formation is mounted. The stage 101 temporary fixes a conveyed medium on the mounting surface, and maintains a state in which the liquid discharged from the head device 103 is adhered onto the medium. The printer 100 includes an image forming area 106 previously set inside the stage 101. The printer 100 discharges the liquid inside the image forming area 106 to form an image on the medium. The printer 100 includes a suction mechanism 107 at a position corresponding to the image forming area 106. The suction mechanism 107 temporarily fixes the medium at a predetermined position in the image forming area 106.

The printer 100 includes the suction mechanism 107 on a back side (lower side in FIG. 2) of the mounting surface 101*a*. The stage 101 includes a plurality of suction holes 108 communicating the mounting surface 101*a* and a back surface 101*b* of the stage 101 in a region corresponding to the image forming area 106 of the stage 101. The suction mechanism 107 operates fans 109 that generate airflow flowing through the suction holes 108 of the stage 101 from the mounting surface 101*a* to the back surface 101*b* of the stage 101.

Specifically, the air above the mounting surface 101*a* is vacuumed from the suction holes 108 toward the back surface 101*b* of the stage 101 by the fans 109. Thus, the medium is attracted to and temporarily stuck to the mounting surface 101*a* of the stage 101 by the airflow generated by the fans 109 of the suction mechanism 107. The suction mechanism 107 is not limited to a configuration using the airflow as described above but may also be a configuration using electrostatic suction.

The carriage 102 is slidably held at a predetermined height above the mounting surface 101*a* of the stage 101. A carriage stay 114 holds the carriage 102. The carriage stay 114 is an elongated bar-shaped member having a length longer than a width of the stage 101. Each longitudinal end of the carriage stay 114 is held by a support 110. Further, the drive motor 111 slidably moves the carriage stay 114 and the carriage 102 in a depth direction of the stage 101. The depth direction is along a sub-scanning direction of the carriage 102.

The drive motor 111 drives the carriage 102 held by the carriage stay 114 to reciprocally move in a width direction of the stage 101 along the carriage stay 114. The width direction of the stage 101 is in a main-scanning direction of the carriage 102 along which the carriage 102 reciprocally moves. Thus, the carriage stay 114 and the drive motor 111 scans the carriage 102 in two dimensions parallel to the mounting surface 101*a* of the stage 101. In the following description, a direction of movement of the carriage 102 along a longitudinal direction of the carriage stay 114 is referred to as the "main-scanning direction" as indicated by arrow "MSD" in FIGS. 1 and 2. Further, a direction of movement of the carriage 102 on the carriage stay 114 in the depth direction of the stage 101 by the drive motor 111 is referred to as the "sub-scanning direction" indicated by arrow "SSD" in FIG. 1.

The carriage 102 mounts a head device 103 including a plurality of the liquid discharge heads 119 to individually discharge liquids of a plurality of colors. Each of the head devices 103 discharges, for example, liquids colored white, cyan, magenta, yellow, black, clear, and primer (treatment liquid). The liquid discharged by the head device 103 according to the present embodiment is a curable liquid having a property of being cured when irradiated with light having a specific wavelength. Thus, the head device 103 can discharge the curable liquid and the processing liquid of each color. Thus, the controller 120 controls the head device 103 to discharge the curable liquid to a predetermined position in the medium temporarily stuck to the stage 101 while scanning the head device 103 in the main-scanning direction MSD and sub-scanning direction SSD by the driving force from the drive motor 111.

Thus, a head scanner includes the drive motor 111, the carriage 102, and the carriage stay 114.

The maintenance units 105*a* and 105*b*, the dummy-discharge receptacle 112, and the capping unit 113 are disposed outside the stage 101 in a scanning range (movable range) of the carriage 102 along the carriage stay 114.

The maintenance unit 105*a* includes webbing 131, for example, to clean the nozzles 130 in the liquid discharge head 119 of the head device 103. With movement of the head device 103 above the maintenance unit 105*a* to face the maintenance unit 105*a*, the maintenance unit 105*a* can clean the nozzles 130 of the liquid discharge head 119 with the webbing 131 to maintain the head device 103 to stably discharge the curable liquid and the processing liquid.

The maintenance unit 105*b* includes the dummy-discharge receptacle 112 within the scanning range of the carriage 102 outside the stage 101 (see FIG. 1). The dummy-discharge receptacle 112 includes a container having a space to receive the liquid discharged by the "dummy-discharge operation" that is one of the maintenance operations of the head device 103. The dummy-discharge receptacle 112 is, for example, a container having a concave shape in cross-section with an opening facing upward to the head device 103 (carriage 102). The dummy-discharge receptacle 112 is installed outside the stage 101. The dummy-discharge receptacle 112 is replaceable with a new dummy-discharge receptacle 112 when full of the liquid related to the dummy-discharge operation.

The capping unit 113 includes caps 113*a* that protects nozzles 130 (see FIG. 3) to prevent the nozzles 130 from drying when the liquid discharge head 119 of the head device 103 does not perform a discharge operation. Thus, the maintenance unit 105*b* includes the dummy-discharge receptacle 112 and the capping unit 113.

The carriage 102 mounts light irradiators 104 that configure light irradiators. Each of the light irradiators 104 includes a light source that emits light having a specific wavelength to cure the curable liquid discharged from the head device 103. The light irradiators 104 include, for example, an ultraviolet lamp (UV lamp) that radiates ultraviolet rays 117 (see FIG. 5) as a light having a specific wavelength. The light irradiator 104 may irradiate an electron beam to cure the curable liquid. The light irradiators 104 irradiate, with ultraviolet rays 117, the curable liquid discharged onto the medium on the stage 101 and the dummy-discharge receptacle 112. As illustrated in FIGS. 1 and 2, the light irradiators 104 may be installed on both sides of the carriage 102 in the main-scanning direction MSD, or may be installed on only one side of the carriage 102 in the main-scanning direction MSD. The light irradiator 104 moves with the movement of the carriage 102.

[Overview of Maintenance Operation]

The printer 100 having a configuration as described-above maintains stable discharge of the nozzles 130 in each of the liquid discharge heads 119 of the head device 103. The printer 100 performs the maintenance operation to prevent the liquid in the nozzles 130 from drying and to prevent dust from entering the nozzles 130. The maintenance units 105*a* and 105*b* perform the maintenance operation. The maintenance unit 105*b* includes the capping unit 113 that includes the caps 113*a* to cap the nozzle surfaces 119*a* (see FIG. 4). The maintenance units 105*a* and 105*b* may include a wiper 132 (also referred to as a wiper blade, a wiping blade, a blade, or the like) installed in the maintenance units 105*a* and 105*b*. The wiper 132 wipes and cleans the nozzle surface 119*a* of the liquid discharge head 119 (recording head).

When the printer 100 performs the maintenance operation, the controller 120 moves the head device 103 to the maintenance unit 105*b* and performs a recovery operation such as wiping the nozzle surface 119*a* of the liquid discharge head 119 with the wiper 132 to form a nozzle meniscus in each of the nozzles 130. Then, the capping unit 113 of the maintenance unit 105*b* caps the nozzle surfaces 119*a* of the liquid discharge heads 119 with caps 113*a* until the next discharge operation.

Further, the printer 100 performs the dummy-discharge operation at a predetermined timing as one of the maintenance operations. The dummy-discharge operation is a discharge operation performed by moving the head device 103 to the dummy-discharge receptacle 112.

[Head Device 103 and Dummy-Discharge Receptacle 112]

Next, the relation between the head device 103 and the dummy-discharge receptacle 112 is described below using FIG. 3.

Figure 3:
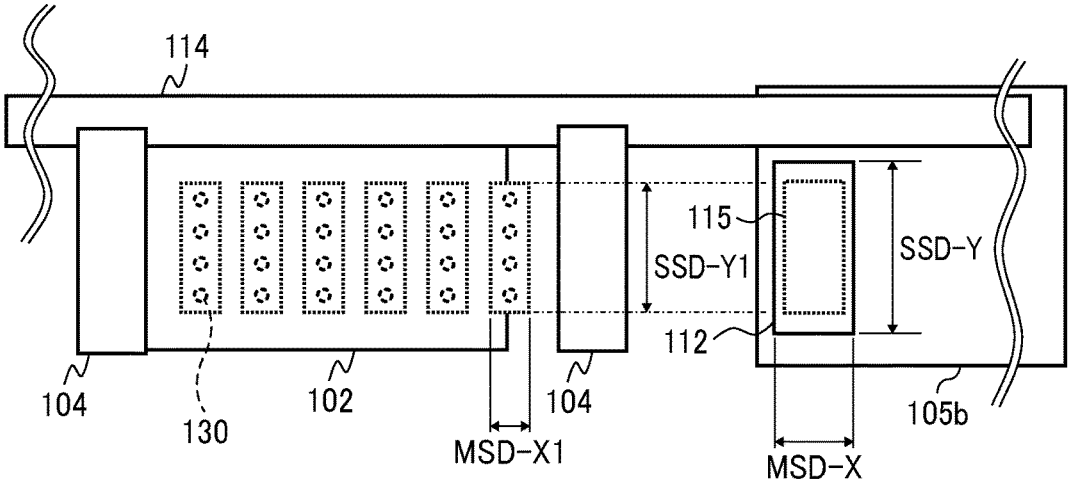
FIG. 3 is a schematic plan view of the main part of the printer.

FIG. 3 is a partial enlarged plan view of the carriage 102 and the dummy-discharge receptacle 112. In FIG. 3, "MAIN-X1" indicates a dimension of one liquid discharge head 119 (recording head) in the head device 103 in the main-scanning direction MSD. Further, "SUB-Y1" in FIG. 3 indicates a dimension in the sub-scanning direction SSD of one liquid discharge head 119 (recording head) in the head device 103.

In FIG. 3, "MAIN-X" indicates a dimension of the dummy-discharge receptacle 112 in the main-scanning direction MSD. Further, "SUB-Y" in FIG. 3 indicates a size of the dummy-discharge receptacle 112 in the sub-scanning direction SSD.

As illustrated in FIG. 3, the dummy-discharge receptacle 112 has an opening larger than a size of one liquid discharge head 119 (recording head) mounted on the head device 103 so that relations of MAIN-X1<MAIN-X and SUB-Y1<SUB-Y are satisfied. Thus, the dummy-discharge receptacle 112 has a dimension "MAIN-X" longer than the dimension "MAIN-X1" of the liquid discharge head 119 in the main scanning direction MSD. Further the dummy-discharge receptacle 112 has a dummy-discharge receiving area 115 corresponding to the dimension of "SUB-Y1" of the liquid discharge head 119 in the sub scanning direction SSD. Thus, when the liquid discharge head 119 (recording head) moves above the dummy-discharge receptacle 112 and performs the dummy-discharge operation, the liquid discharged as the dummy-discharge liquid 116 (see FIG. 4) is reliably stored and stacked in the dummy-discharge receptacle 112.

[Interference Between Dummy-Discharge Liquid 116 and Head Device 103]

Figure 4:
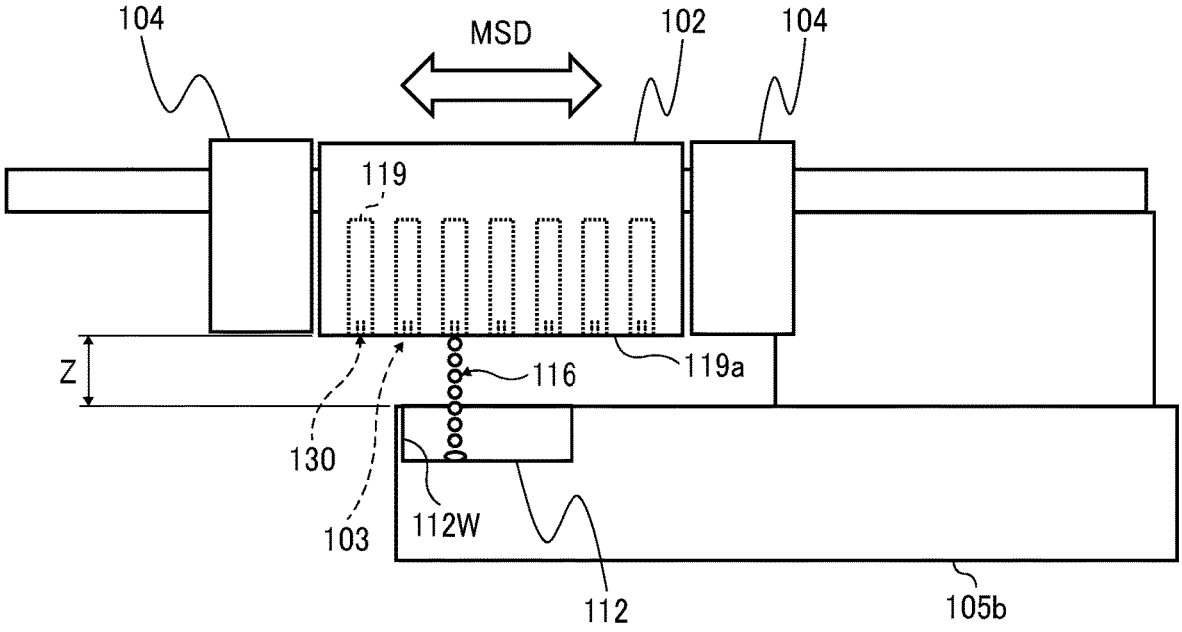
FIG. 4 is a schematic front view of the main part of the printer illustrating a dummy-discharge operation of the printer.

As illustrated in FIG. 4, when the head device 103 moves above the dummy-discharge receptacle 112 and performs the dummy-discharge operation to the dummy-discharge receptacle 112, the dummy-discharge liquid 116 discharge by the dummy-discharge operation are stored and accumulated inside the dummy-discharge receptacle 112. When a height of accumulated dummy-discharge liquids 116 reaches "a certain height", the accumulated dummy-discharge liquids 116 interfere (contact) with the carriage 102 and the liquid discharge head 119 (recording head). Here, "a certain height" refers to, for example, a distance (height Z) from an upper end of the dummy-discharge receptacle 112 to the nozzle surface 119*a* of the liquid discharge head 119 (recording head) or a bottom surface of the carriage 102. Thus, when the dummy-discharge liquids 116 accumulate to the height Z, the dummy-discharge liquids 116 may hinder the scanning movement of the carriage 102. The printer 100 according to the present embodiment can prevent such interference beforehand and efficiently collect the dummy-discharge liquid 116.

[Light (Ultraviolet) Irradiation of Dummy-Discharge Liquids 116]

Figure 5:
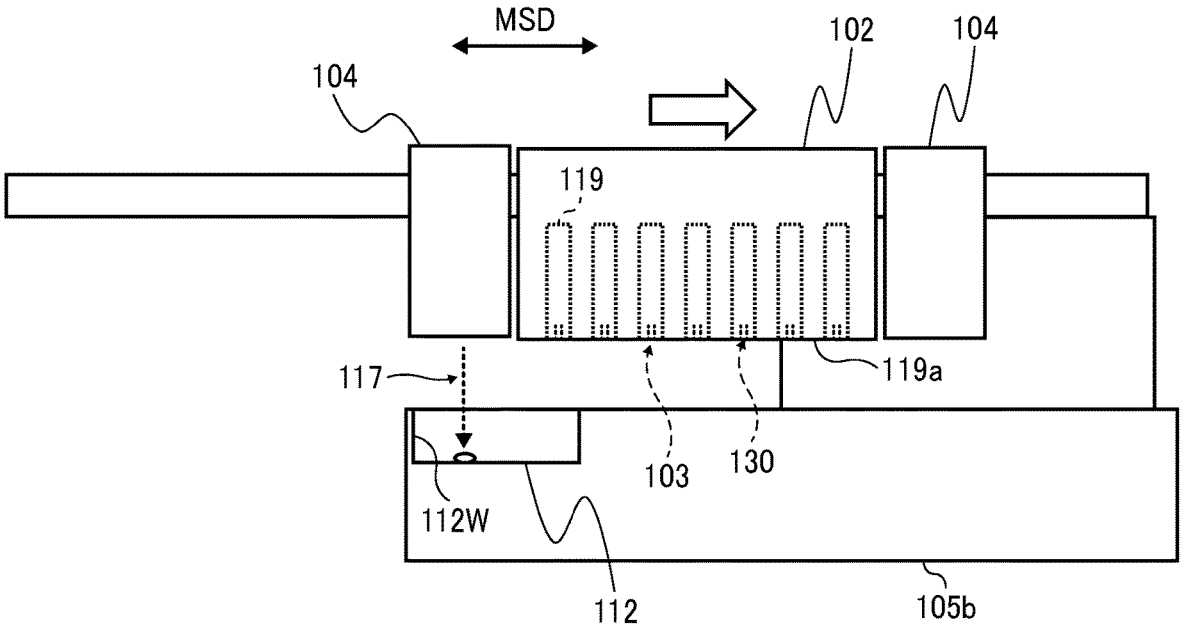
FIG. 5 is a schematic front view of the main part of the printer illustrating the dummy-discharge operation of the printer.

As illustrated in FIG. 5, the light irradiator 104 as the light irradiator irradiates the dummy-discharge liquid 116 stored in the dummy-discharge receptacle 112 with ultraviolet rays 117 to cure the dummy-discharge liquids 116 in an interior of the dummy-discharge receptacle 112. Thus, the printer 100 can prevent generation of odor due to volatilization of the dummy-discharge liquid in the dummy-discharge receptacle 112.

FIG. 5 is a cross-sectional partial front view of the printer 100. FIG. 5 illustrates an irradiation operation in which the light irradiator 104 irradiates the dummy-discharge liquid 116 in the dummy-discharge receptacle 112 with the ultraviolet rays 117 when the light irradiator 104 passes above a landing position of the dummy-discharge liquid 116 in the dummy-discharge receptacle 112 during scanning movement of the carriage 102 in the main-scanning direction MSD in the dummy-discharge operation.

The controller 120 controls irradiation timing, duration of irradiation, and output (irradiation amount) of the light irradiator 104 during the dummy-discharge operation. The light irradiator 104 also irradiates the liquid discharged to the image forming area 106 with the light (ultraviolet rays). The controller 120 controls the irradiation timing, duration of irradiation, and the output during irradiation (irradiation amount) of the light (ultraviolet rays).

The carriage 102 mounts the light irradiators 104 at both ends of the carriage 102 in the main scanning direction MSD. Thus, the light irradiator 104 installed on a left side of the carriage 102 irradiates the ultraviolet rays 117 on the dummy-discharge liquid 116 in the dummy-discharge receptacle 112 when the carriage 102 moves right side in a front view in FIG. 5. Conversely, the light irradiator 104 installed on a right side of the carriage 102 irradiates the ultraviolet rays 117 on the dummy-discharge liquid 116 in the dummy-discharge receptacle 112 when the carriage 102 moves left side in a front view in FIG. 5. Further, both of the light irradiators 104 may operate to irradiate the dummy-discharge liquid 116 with the light (ultraviolet rays) during the dummy-discharge operation.

Further, the light irradiator 104 may change an irradiation amount of the light (ultraviolet rays) onto the dummy-discharge liquid 116 according to a droplet size of the dummy-discharge liquid 116 discharged by the dummy-discharge operation when the discharge operation on the image forming area 106 and a discharge amount of liquid (size of liquid droplet) in the dummy-discharge operation are changed.

Figure 6:
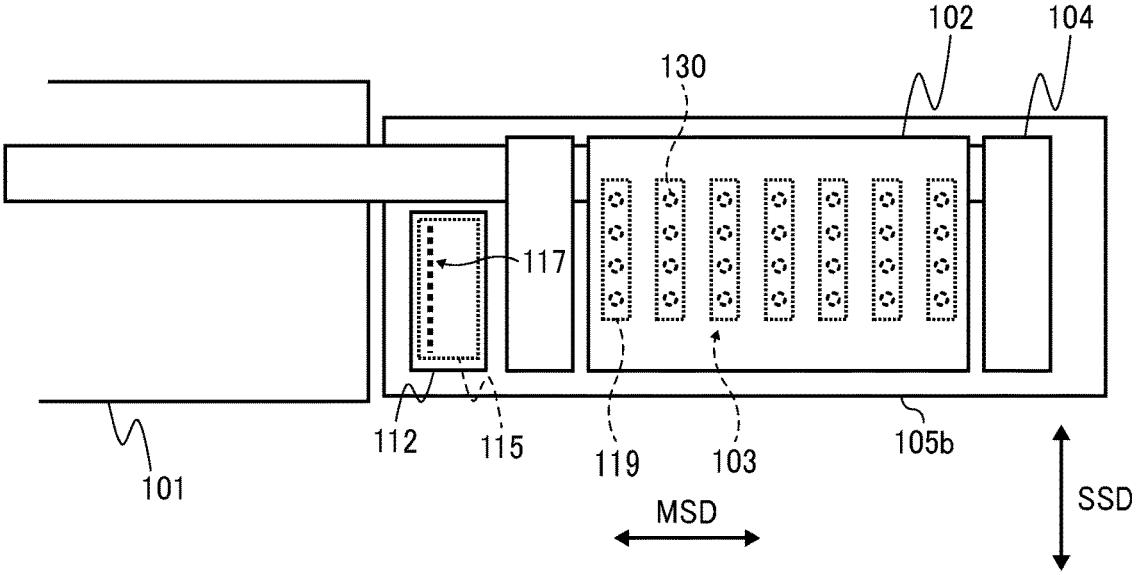
FIG. 6 is a schematic plan view of the main part of the printer illustrating the dummy-discharge operation of the printer.

FIG. 6 is a partial plan view of the printer 100 in a state of the dummy-discharge receptacle 112 after performing the dummy-discharge operation. As illustrated in FIG. 6, the dummy-discharge liquid 116 is landed on a side close to the stage 101 in the dummy-discharge receiving area 115 that is the interior of the dummy-discharge receptacle 112 and is cured at the landing position by irradiation of the liquid with the light (radiation) such as the ultraviolet rays 117.

As illustrated in FIG. 6, the liquid discharge head 119 (recording head) discharges the dummy-discharge liquid 116 from the nozzles 130 to the dummy-discharge receptacle 112 at a position above a specific position of the dummy-discharge receptacle 112. The nozzles 130 are arrayed in the sub-scanning direction SSD in each of the liquid discharge head 119 as illustrated in FIG. 6. During the dummy-discharge operation, either only a specific liquid discharge head 119 (recording head) may discharge the dummy-discharge liquid 116, or plurality of the liquid discharge heads 119 (recording heads) may discharge the dummy-discharge liquid 116. As a result of the dummy-discharge operation, the cured dummy-discharge liquid 116 inside the dummy-discharge receptacle 112 is arranged in the sub-scanning direction SSD (see FIG. 6).

[Example of Dummy-Discharge Receptacle 112 after Dummy-Discharge Operation]

Figure 7:
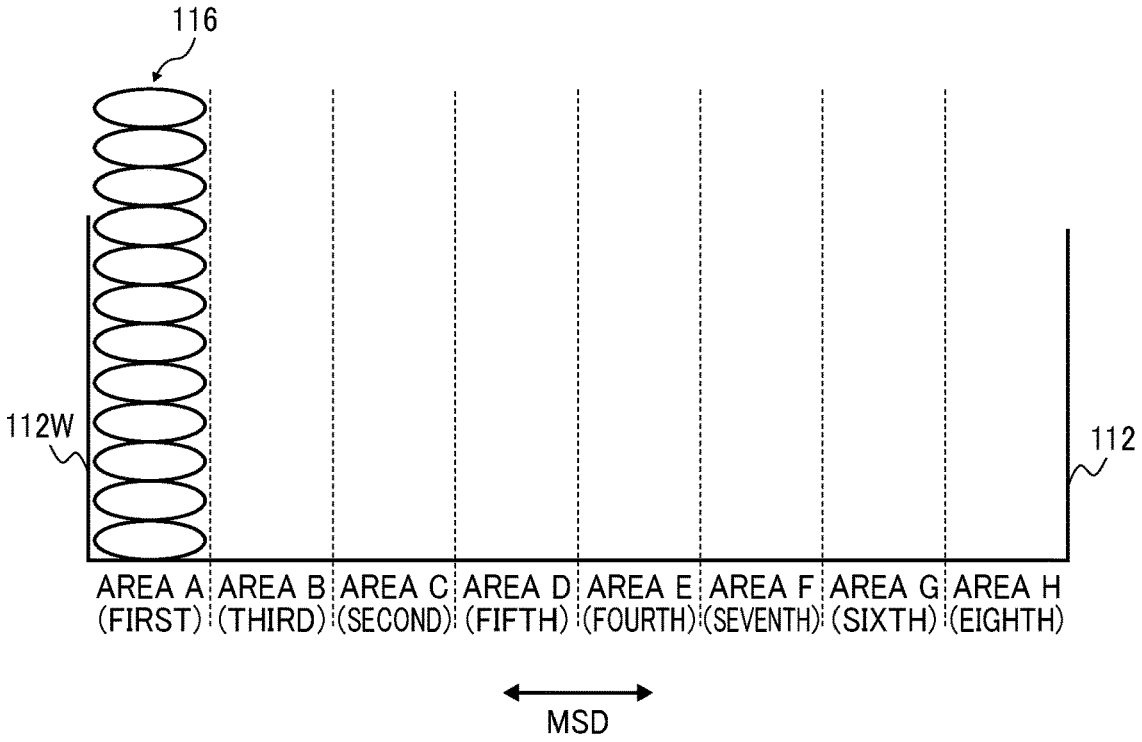
FIG. 7 is a schematic cross-sectional view of a dummy-discharge receptacle illustrating a state of accumulated dummy-discharge liquids by the dummy-discharge operation in the present embodiment.

FIG. 7 is a schematic cross-sectional view of the dummy-discharge receptacle 112 that is a container having a concave shape in cross-section with the opening facing upward to the carriage 102. First, when the dummy-discharge operation is first performed from a state in which the dummy-discharge operation is not performed, the controller 120 performs the dummy-discharge operation at a position along an inner wall surface of the dummy-discharge receptacle 112 parallel to a side surface of the stage 101. Thus, the dummy-discharge liquids 116 are landed at positions along the inner wall surface of the dummy-discharge receptacle 112 in the sub-scanning direction SSD.

As illustrated in FIG. 7, a virtually divided "dummy-discharge areas" are set in the interior of the dummy-discharge receptacle 112. The controller 120 performs a virtual setting of the dummy-discharge areas. An example illustrated in FIG. 7 is an example in which eight dummy-discharge areas (areas A to H) are set.

A plurality of dummy-discharge areas are virtually set in the dummy-discharge receptacle 112 according to the present embodiment. The controller 120 determines to which of the dummy-discharge area the dummy-discharge operation is performed. Thus, the controller 120 determines a size (width) of the dummy-discharge area in the main-scanning direction MSD based on a physical size of the dummy-discharge receptacle 112, the size of the dummy-discharge liquid 116 discharged by the dummy-discharge operation, and the size of the dummy-discharge liquid 116 after the dummy-discharge liquid 116 is cured. Further, the controller 120 controls the scanning movement of the head device 103 to the dummy-discharge area based on the above-described virtual setting.

As illustrated in FIG. 7, when the dummy-discharge liquids 116 are accumulated (stacked) to reach the specific height Z (see FIG. 4), the dummy-discharge liquids 116 may interfere with (contact) the carriage 102. Here, the dummy-discharge liquids 116 may be accumulated (stacked) higher than a side wall 112W of the dummy-discharge receptacle 112 as indicated by solid line in FIG. 7 unless the height of accumulated dummy-discharge liquids 116 is lower than the height Z. Thus, the height Z may be set higher than the side wall 112W of the dummy-discharge receptacle 112.

Therefore, the controller 120 controls to move the position of the carriage 102 to change the dummy-discharge area based on an accumulated (stacked) height of the dummy-discharge liquids 116 in the dummy-discharge receptacle 112. For example, the controller 120 may perform the dummy-discharge operation in another area (an area C, for example) as a second dummy-discharge area after performing the dummy-discharge operation for a predetermined number in an area A (first dummy-discharge area).

[First Example of Setting of Dummy-Discharge Area]

Figure 8:
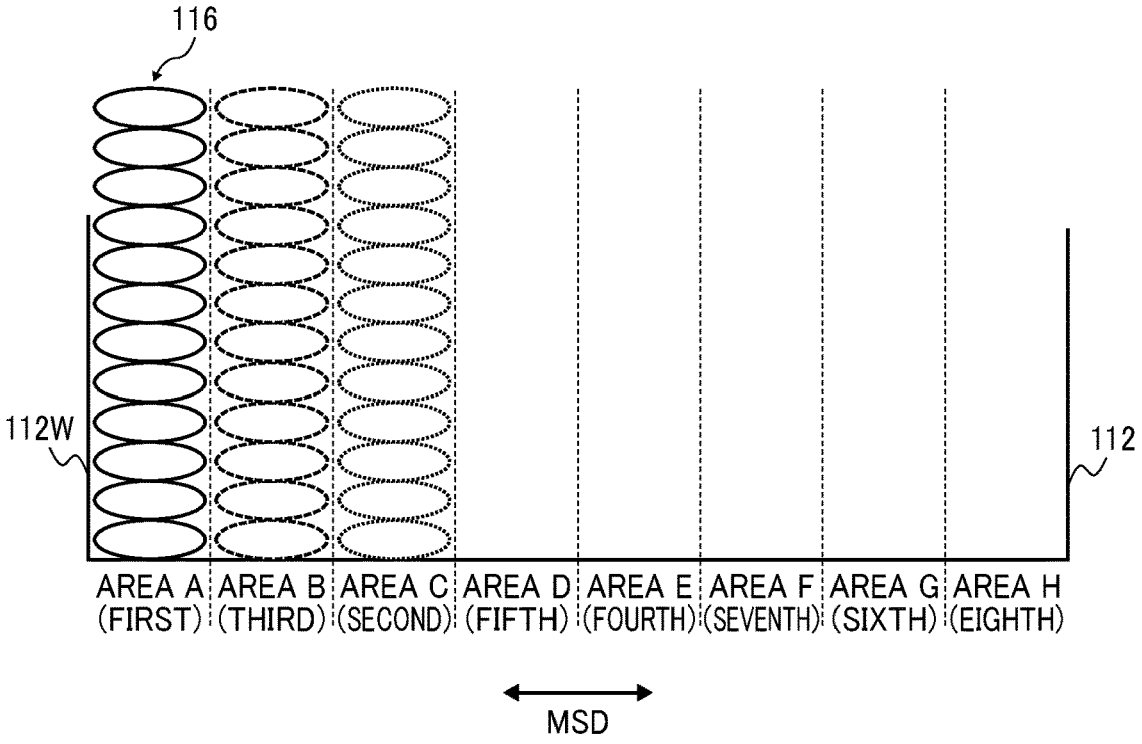
FIG. 8 is a schematic cross-sectional view of the dummy-discharge receptacle illustrating another example of a state of accumulated dummy-discharge liquids by the dummy-discharge operation in the present embodiment.

FIG. 8 is a schematic cross-sectional view of the dummy-discharge receptacle 112. FIG. 8 illustrates an example of setting the dummy-discharge area for the dummy-discharge operation. As illustrated in FIG. 8, first, the dummy-discharge operation is performed in the area A. A height of accumulated (stacked) dummy-discharge liquids 116 in one dummy-discharge operation can be calculated based on a size of a dummy-discharge liquid 116 discharged by one dummy-discharge operation. Further, the controller 120 controls a number of the dummy-discharge operations performed in one maintenance operation. Thus, the controller 120 controls the head device 103 to perform the dummy-discharge operation to the dummy-discharge area until the height of accumulated (stacked) dummy-discharge liquids 116 in the dummy-discharge area at time of a current setting exceeds a predetermined threshold value.

That is, the controller 120 calculates the height of accumulated (stacked) dummy-discharge liquids 116 in the dummy-discharge area of the dummy-discharge receptacle 112 based on an accumulated number of dummy-discharge operations, a height of cured dummy-discharge liquid 116 at one dummy-discharge operation, and the size of the dummy-discharge liquid 116 discharged by one dummy-discharge operation. Further, the controller 120 determines whether the height of the accumulated (stacked) dummy-discharge liquids 116 exceeds a predetermined threshold. When the controller 120 determines that the height of accumulated (stacked) dummy-discharge liquids 116 becomes equal to or greater than a first threshold value, the controller 120 sets another dummy-discharge area (second dummy-discharge area). In an example illustrated in FIG. 8, the controller 120 sets the area C as the dummy-discharge area for the next dummy-discharge operation.

The controller 120 according to the present embodiment sets the first threshold value using a number of dummy-discharge operations successively performed until the height of accumulated (stacked) dummy-discharge liquids 116 reaches the height Z. Then, the controller 120 changes the setting of the dummy-discharge area using the first threshold value as described above.

When the number of the dummy-discharge operations on the area C exceeds the first threshold value, the controller 120 sets the area B as the next dummy-discharge area. When the dummy-discharge operation on the area B exceeds the first threshold, the controller 120 next sets the area E as the next dummy-discharge area. Similarly, the controller 120 next sets an area D as the next dummy-discharge area.

That is, as illustrated in FIG. 8, the controller 120 sets a dummy-discharge area (area C, etc.) not adjacent to a current dummy-discharge area (area A, etc.) as the next dummy-discharge area when the height of accumulated (stacked) dummy-discharge liquid 116 exceeds the first threshold value as a result of the dummy-discharge operation on a certain dummy-discharge area (area A, etc.). In the above-described case, the controller 120 sets the next dummy-discharge area using the dummy-discharge area (area C, etc.) not adjacent to the current dummy-discharge area (area A, etc.).

Specifically, the controller 120 sets the dummy-discharge area (area C, etc.) adjacent to the dummy-discharge area (area B, etc.) that is adjacent to the current dummy-discharge area (area A, etc.) that is, a dummy-discharge area corresponding to a next adjacent dummy-discharge area. Then, the controller 120 sets the next dummy-discharge area using the dummy-discharge area (area B, etc.) adjacent to both the previous dummy-discharge area (area A, etc.) and the current dummy-discharge area (area C, etc.) when the height of accumulated (stacked) dummy-discharge liquids 116 exceeds the first threshold value as a result of the dummy-discharge operation on the current dummy-discharge area (area C, etc).

[Second Example of Setting of Dummy-Discharge Area]

Figure 9:
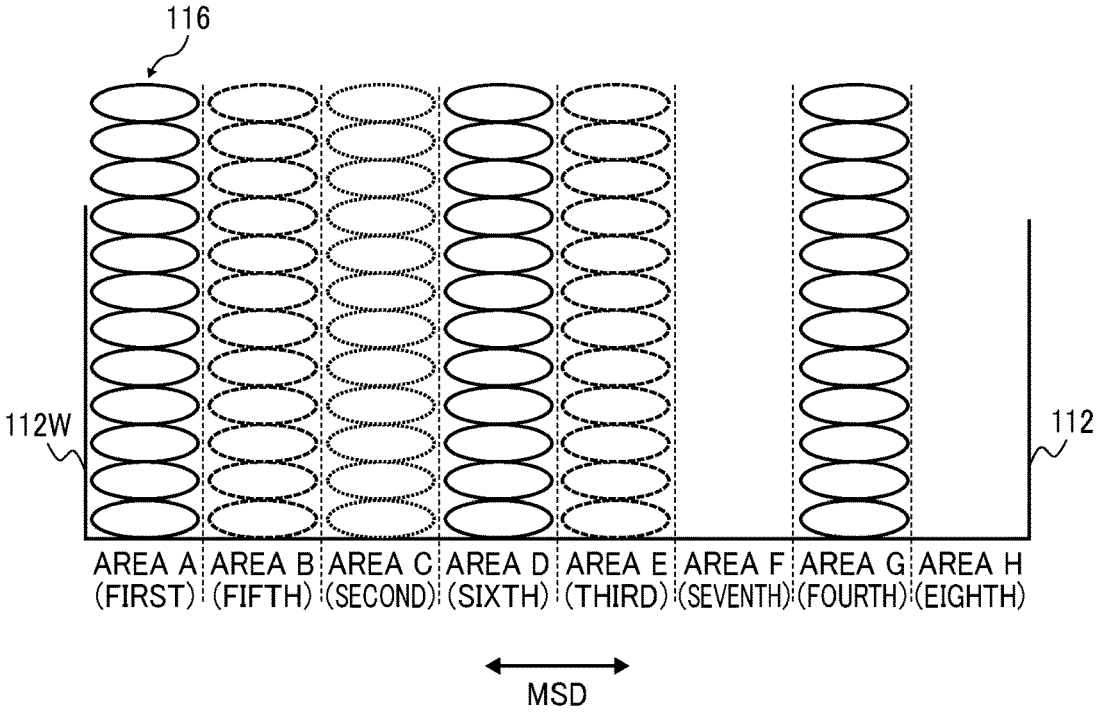
FIG. 9 is a schematic cross-sectional view of a dummy-discharge receptacle illustrating still another example of a state of accumulated dummy-discharge liquids by the dummy-discharge operation in the present embodiment.

Further, as illustrated in FIG. 9, the controller 120 can set the next dummy-discharge area in an order of area A, area C, area E, area G, area B, area D, area F, and area H. In the above-described case, the controller 120 sets the next dummy-discharge area using the dummy-discharge area (areas C, E, G, etc.) not adjacent to the current dummy-discharge area (areas A, C, E, etc.) when the height of accumulated (stacked) dummy-discharge liquids 116 exceeds the first threshold value as a result of the dummy-discharge operation on a certain (current) dummy-discharge area (areas A, C, E, etc.). That is, the controller 120 sets the next dummy-discharge area using a dummy-discharge area (area C, etc.) not adjacent to the current dummy-discharge area (area A, etc). Specifically, the next dummy-discharge area (area C, etc.) is adjacent to the dummy-discharge area (area B, etc) adjacent to the current dummy-discharge area (area A, etc.) that is the dummy-discharge area corresponding to the next adjacent dummy-discharge area.

Then, the controller 120 sets the next dummy-discharge area (area E, etc.) that is the next adjacent dummy-discharge area when the height of accumulated (stacked) dummy-discharge liquids 116 exceeds the first threshold value as a result of the dummy-discharge operation on the current dummy-discharge area (area C, etc.). Then, the controller 120 sets the next dummy-discharge area using the dummy-discharge area (area B, etc.) between the dummy-discharge areas (areas A and C, etc.), onto which the dummy-discharge liquids 116 has already been accumulated (stacked), and has not been used for the dummy-discharge operation when a position of the current dummy-discharge area (area G, etc.) reaches a position corresponding to a width (MAIN-X) of the dummy-discharge receiving area 115 in the dummy-discharge receptacle 112 (see FIG. 3).

As described above, the controller 120 sets the area A that is a (one) dummy-discharge area among a plurality of dummy-discharge areas as the next dummy-discharge area to perform the dummy-discharge operation, and performs the dummy-discharge operation on the area A. The controller 120 continuously performs the dummy-discharge operations on the area A as the current dummy-discharge area until an amount (height) of stored (accumulated or stacked) dummy-discharge liquids 116 in the area A reaches a predetermined amount (predetermined height Z). Here, the "amount of dummy-discharge liquids 116 in the area A" refers to the "height of accumulated (stacked) dummy-discharge liquids 116 in the area A".

Further, "the amount of dummy-discharge liquids 116 in the area A reaches a predetermined amount" means that the number of dummy-discharge operations reaches the first threshold value so that the height of accumulated (stacked) dummy-discharge liquids 116 in the area A becomes equal to or higher than the height Z, at which point the accumulated (stacked) dummy-discharge liquids 116 interferes with (contacts) the carriage 102 (i.e., the number of dummy-discharge operations exceeds a predetermined number of times (first threshold value)). Thus, the controller 120 changes the next dummy-discharge area according to a dummy-discharge operation immediately before the number of dummy-discharge operations exceeds a predetermined number of times (first threshold value).

Further, the controller 120 sets the area C as the next dummy-discharge area when the amount of the dummy-discharge liquids 116 stored (accumulated or stacked) in the area A reaches a predetermined amount. The area C is another dummy-discharge area (second dummy-discharge area) not adjacent to the area A (first dummy-discharge area). Thus, the second dummy-discharge area is separate from the first dummy-discharge area.

Then, the controller 120 sets the area B between the area A and the area C as the next dummy-discharge area when an amount (height) of dummy-discharge liquids 116 stored (accumulated or stacked) in the area C reaches a predetermined amount (predetermined height Z).

Note that, if the dummy-discharge areas are set in an order from an end of the dummy-discharge receptacle 112, such as an area A, an area B, an area C, an area D, an area E, an area F, an area G, and an area H, the dummy-discharge liquids 116 in one dummy-discharge area may adhere to the dummy-discharge liquids 116 accumulated (stacked) in the adjacent dummy-discharge area by surface tension. Thus, the amount (height) of accumulated (stacked) dummy-discharge liquids 116 in one dummy-discharge area may exceed the first threshold value with an amount of the dummy-discharge liquid 116 smaller than a capacity of accumulated (stacked) dummy-discharge liquids 116 accommodatable in one dummy-discharge area in the dummy-discharge receptacle 112.

In each of the areas A to H, the dummy-discharge liquids 116 stored (accumulated) in the dummy-discharge receptacle 112, amount of which reaches the predetermined amount, are irradiated with the light (ultraviolet rays, etc.) at a predetermined timing to be cured. Thus, the dummy-discharge liquids 116 cured in the dummy-discharge receptacle 112 becomes partition walls to partition an interior of the dummy-discharge receptacle 112 into multiple separate areas. Thus, if the controller 120 sets the next dummy-discharge area in an order of the area A, the area C, and the area B, the dummy-discharge liquids 116 discharged by the dummy-discharge operation performed on the area B flow into a gap formed between the dummy-discharge liquids 116 accumulated (stacked) in each of the areas A and C. Thus, the printer 100 can efficiently fill a storage area of the dummy-discharge receptacle 112 with the dummy-discharge liquids 116.

[Another Example of the Dummy-Discharge Receptacle 112]

Figure 10:
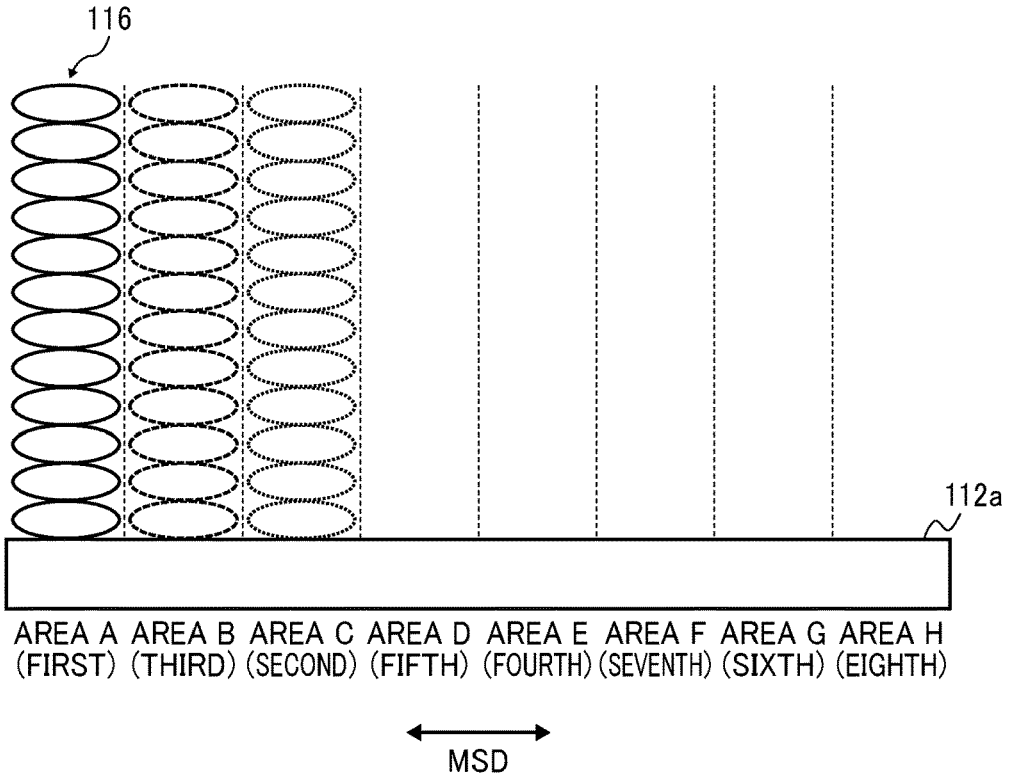
FIG. 10 is a schematic cross-sectional view of a dummy-discharge receptacle illustrating still another example of a state of accumulated dummy-discharge liquids by the dummy-discharge operation in the present embodiment.

Note that the dummy-discharge receptacle 112 is not limited to a container having a concave shaped cross-section as illustrated in FIG. 7 and the like, but may also be a planar member such as the dummy-discharge receptacle 112*a* as illustrated in FIG. 10. In the dummy-discharge receptacle 112*a* in FIG. 10, the dummy-discharge liquids 116 accumulated (stacked) in the dummy-discharge area (area A) by the first dummy-discharge operation form a partition wall in the dummy-discharge receptacle 112. The partition wall partitions the interior of the dummy-discharge receptacle 112. Thus, the controller 120 sets a dummy-discharge area (area C) not adjacent to the area A (first dummy-discharge area) as the next (second) dummy-discharge area. Thus, the second dummy-discharge area (area C) is separated from the first dummy-discharge area (area A).

[Third Example of Setting of Dummy-Discharge Area]

Figure 11:
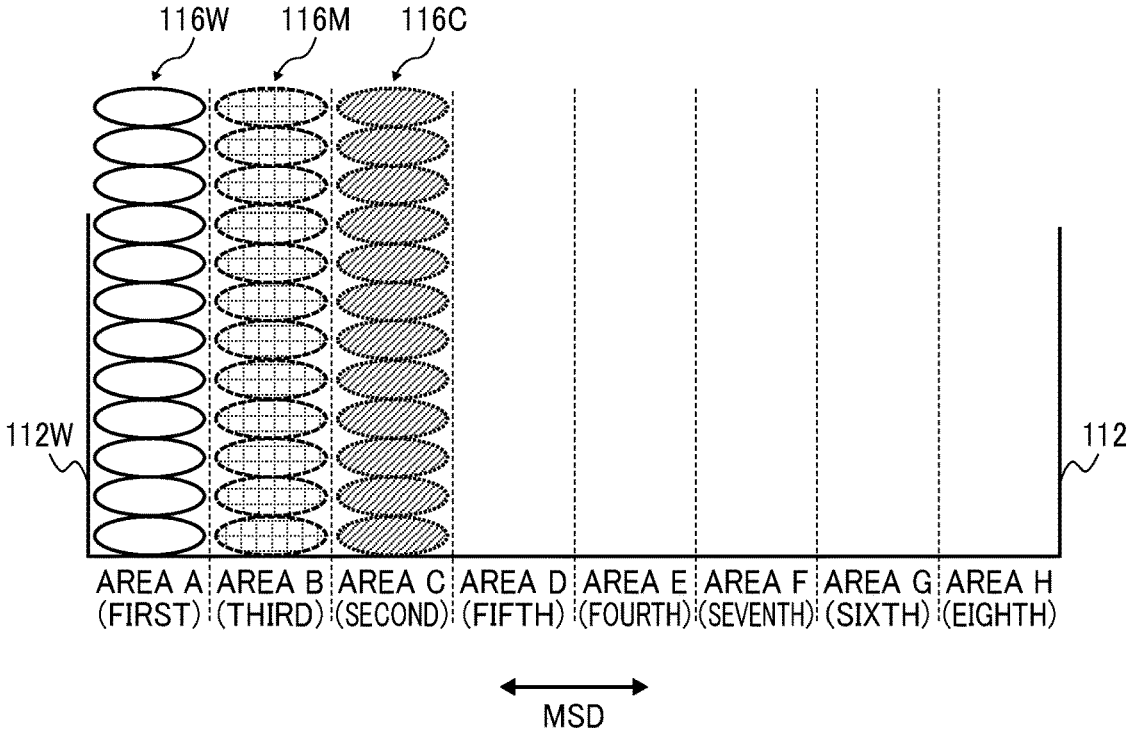
FIG. 11 is a schematic cross-sectional view of a dummy-discharge receptacle illustrating still another example of a state of accumulated dummy-discharge liquids by the dummy-discharge operation in the present embodiment.

As illustrate in FIG. 11, the controller 120 can set separate dummy-discharge areas for each of the liquid discharge heads 119 (recording heads) performing a dummy-discharge operation. Thus, the controller 120 sets the area A as a dummy-discharge area for dummy-discharge liquids 116W of white color as illustrated in FIG. 11. Thus, the dummy-discharge liquids 116W of white color are accumulated (stacked) in the area A in the dummy-discharge receptacle 112. Further, the controller 120 sets the area C as a dummy-discharge area for dummy-discharge liquids 116C of cyan color. Thus, the dummy-discharge liquids 116C of cyan color are accumulated (stacked) in the area C in the dummy-discharge receptacle 112. Further, the controller 120 sets the area B as a dummy-discharge area for dummy-discharge liquids 116M of magenta color. Thus, the dummy-discharge liquids 116M of magenta color are accumulated (stacked) in the area B in the dummy-discharge receptacle 112.

As described above, the controller 120 sets the next dummy-discharge area for each color of the dummy-discharge liquids 116 (for each of the liquid discharge heads 119 (recording heads)). Thus, the printer 100 can prevent mixing of colors in the dummy-discharge receptacle 112 even when the dummy-discharge liquids 116 rebounds to the liquid discharge head 119 because a color of the dummy-discharge liquid 116 rebounding to the liquid discharge head 119 and a color of the liquid discharge head 119 is the same. In FIG. 11, the controller 120 previously irradiates the dummy-discharge liquids 116 with the light such as ultraviolet rays to cure the dummy-discharge liquids 116 discharged by a previous dummy-discharge operation.

The plurality of dummy-discharge areas respectively accommodates a plurality of dummy-discharge liquids 116 of respective colors.

Further, the printer 100 may respectively include a plurality of dummy-discharge receptacles 112 for a plurality of types (colors) of dummy-discharge liquids 116 to prevent mixing of colors in the dummy-discharge receptacle 112.

[Fourth Example of Setting of Dummy-Discharge Area]

Figure 12:
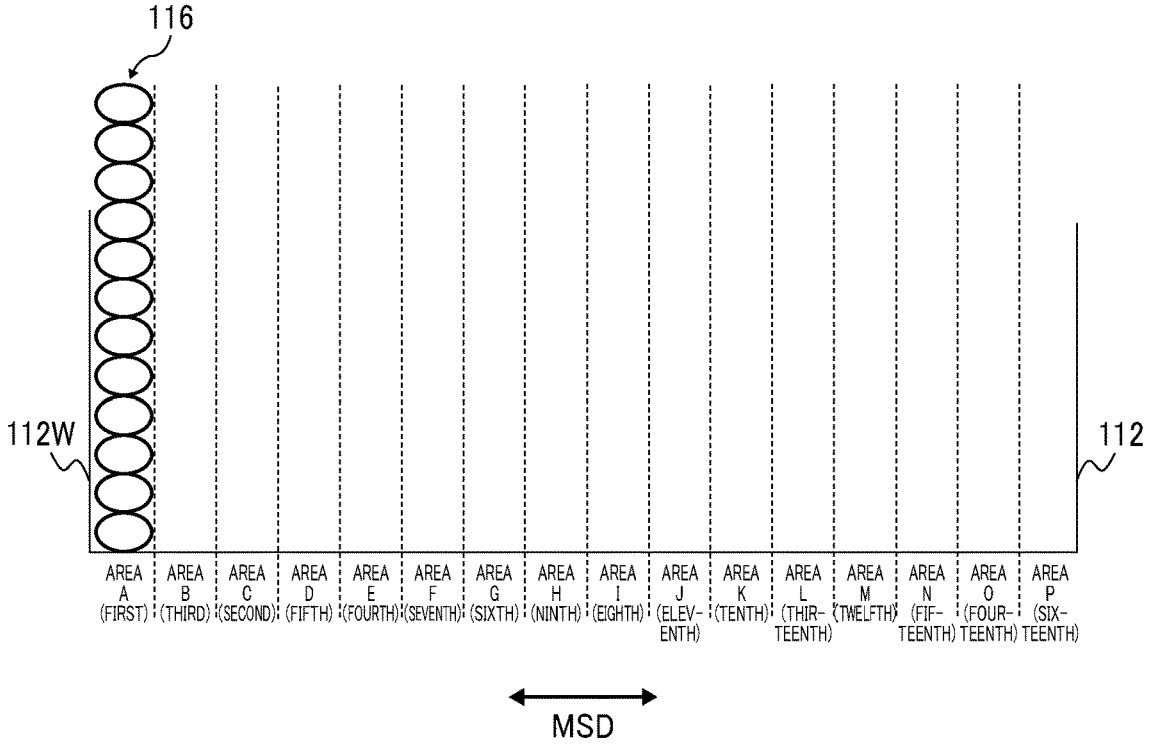
FIG. 12 is a schematic cross-sectional view of a dummy-discharge receptacle illustrating still another example of a state of accumulated dummy-discharge liquids by the dummy-discharge operation in the present embodiment.

The controller 120 can set a size of liquid droplet of the dummy-discharge liquid 116 to be small (small droplets) to increase a number of dummy-discharge areas even for the dummy-discharge receptacle 112 of the same size. For example, the controller 120 may set sixteen dummy-discharge areas as illustrated in FIG. 12. The controller 120 controls a size of each of the dummy-discharge areas. Since the controller 120 can control the size of each of the dummy-discharge liquids 116 discharged by the dummy-discharge operation, the size of each of the dummy-discharge areas is set in conjunction with the control of the size of each of the dummy-discharge liquids 116.

As illustrated in FIG. 12, the controller 120 can change the size of the dummy-discharge area. Particularly, the controller 120 reduces the setting (size) of the dummy-discharge area. Thus, a gap between the partition walls formed by the cured dummy-discharge liquids 116 becomes small when the dummy-discharge liquids 116 discharged to each dummy-discharge area are cured by the light such as ultraviolet rays. Thus, the printer 100 can use every corner of an accommodation area of the dummy-discharge receptacle 112. Further, the controller 120 reduces the size of each of the dummy-discharge liquids 116 during the dummy-discharge operation so that an amount of liquid consumed in the dummy-discharge operation can be reduced. Thus, inefficient liquid consumption can be reduced.

Further, the controller 120 may measure a number of discharge operations (discharge history) for image formation for each liquid discharge heads 119 (for each color). Thus, the controller 120 reduce a number of the dummy-discharge operation and an amount of the dummy-discharge liquids 116 discharged per one time of the dummy-discharge operation for the liquid discharge head 119 (recording head) that performs more discharge operations than other liquid discharge heads 119.

[Medium Thickness and Dummy-Discharge Operation]

Next, a dummy-discharge operation performed in a state in which a substrate 118 as a medium is placed on the stage 101.

Figure 13:
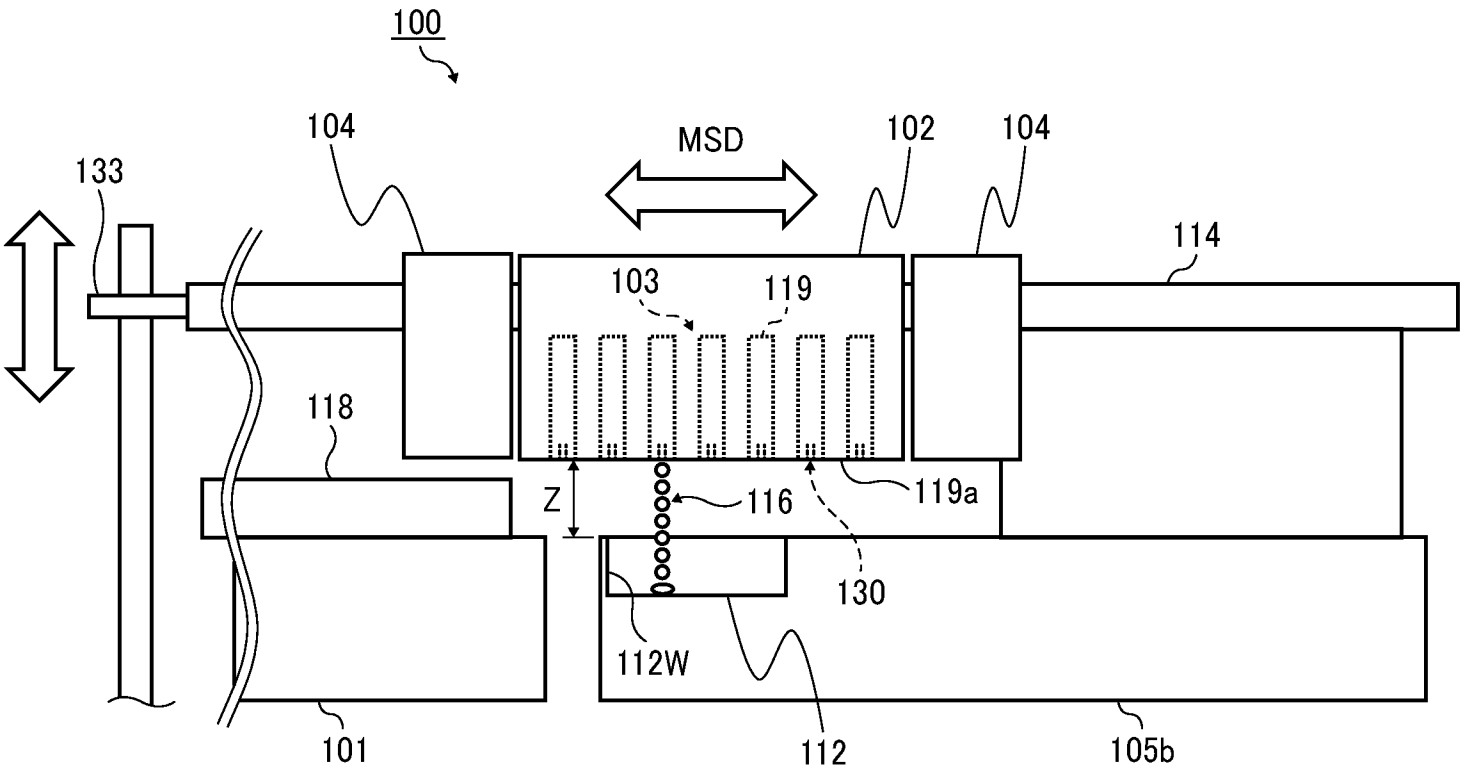
FIG. 13 is a schematic front view of the main part of the printer illustrating the dummy-discharge operation according to the present embodiment.

FIG. 13 is a partial front view of the printer 100 in a state in which the substrate 118 is placed on the stage 101. As illustrated in FIG. 13, the controller 120 changes a size of a gap between an upper surface of the stage 101 and the nozzle surface 119*a* of the liquid discharge head 119 on the carriage 102 according to a thickness of the substrate 118. The printer 100 includes a carriage lift 133 to raise or lower the carriage 102 as indicated by vertical arrow in FIG. 13. The carriage lift 133 moves the carriage 102, the head device 103, the light irradiator 104, and the carriage stay 114 in a vertical direction to change the size of the gap between the nozzle surface 119*a* and the upper surface of the stage 101.

Conversely, the stage 101 and the maintenance unit 105*b* may be vertically movable relative to the carriage 102 and the head device 103. Therefore, the controller 120 may change (correct) the first threshold value according to the thickness of the substrate 118 even when the first threshold value is used to change the setting of the dummy-discharge area during the dummy-discharge operation. More specifically, the controller 120 changes a height position of the carriage 102 by setting a thickness of the substrate 118 in the controller 120. For example, as illustrated in FIG. 13, the carriage 102 is raised (larger gap) when the substrate 118 is thicker, and the carriage 102 is lowered (smaller gap) when the substrate 118 is thinner. The controller 120 may correct the first threshold value based on the changed height position of the carriage 102.

[Size of Dummy-Discharge Liquid of Dummy-Discharge Operation and First Threshold Value]

Figure 14:
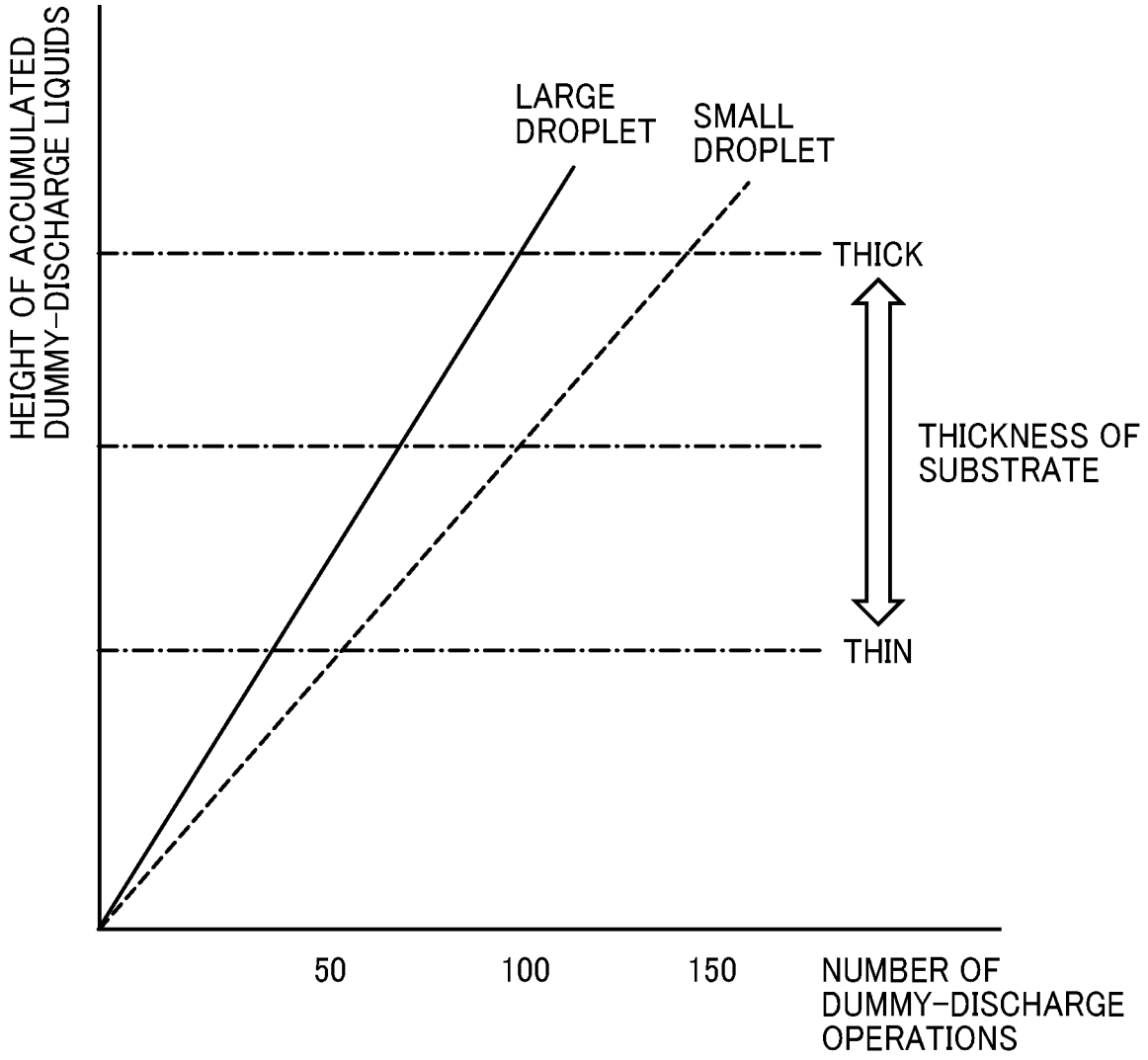
FIG. 14 is a graph illustrating a correlation between a number of dummy discharges in the dummy-discharge operation and a height of accumulated dummy-discharge liquids.

FIG. 14 is a graph of correlation between a number of dummy discharge in the dummy-discharge operation and the height of accumulated (stacked) dummy-discharge liquids 116. A solid line in FIG. 14 illustrates an example in which the size of the dummy-discharge liquid 116 in the dummy-discharge operation is a "large droplet". Conversely, a broken line in FIG. 14 illustrates an example in which the size of the dummy-discharge liquid 116 in the dummy-discharge operation is "small droplet". As illustrated in FIG. 14, the height of accumulated dummy-discharge liquids 116 of the large droplet is higher than the height of accumulated dummy-discharge liquids 116 of the small droplet for the same number of dummy-discharge operations.

Further, FIG. 14 illustrates the difference of the "height Z" between the nozzle surface 119*a* of the liquid discharge head 119 (recording head) and the top surface of the stage 101 by a difference in the thickness of the substrate 118 by dash-single-dot lines. As illustrated in FIG. 13, the carriage 102 is raised (larger gap) when the substrate 118 is thick, and the carriage 102 is lowered (smaller gap) when the substrate 118 is thin. As illustrated in FIG. 14, the "height Z" increases when the thickness of the substrate 118 is "thick". If the height Z is large, the height of accumulated dummy-discharge liquids 116 needed for interfering (contacting) the carriage 102 (nozzle surface 119*a*) increases. Conversely, the "height Z" decreases when the thickness of the substrate 118 is "thin". If the height Z is small, the height of accumulated dummy-discharge liquids 116 needed for interfering (contacting) the carriage 102 (nozzle surface 119*a*) decreases.

As described above, the controller 120 raises the carriage 102 to increase the "height Z" when the thickness of the substrate 118 increases. Thus, the height of accumulated dummy-discharge liquids 116 needed to interfere (contact) the carriage 102 (nozzle surface 119*a*) increases (clearance increases) even if the number of dummy-discharge operations in one dummy-discharge area increases. The "clearance" is a gap between the nozzle surface 119*a* of the liquid discharge head 119 and a top of the accumulated dummy-discharge liquids 116. Further, the controller 120 reduces the size of the dummy-discharge liquid 116 during the dummy-discharge operation to further increase the number of dummy-discharge operations in one dummy-discharge area.

[Setting of Dummy-Discharge Operation and First Threshold Value]

The printer 100 according to the present embodiment can also determine the timing of performing the dummy-discharge operation based on the number of the discharge operations for the image formation. For example, the controller 120 may cumulatively add a number of discharge operations for each liquid discharge heads 119 (recording heads), that is, for each discharged colors.

Then, the controller 120 may perform the maintenance operation (dummy-discharge operation) on only the liquid discharge head 119 (recording head) when a cumulatively added value of the number of discharge operations equals or exceeds a predetermined value (first threshold value). Hereinafter, the "cumulatively added value" is also referred to as an "integrated value" or a "cumulative number". In the above-described case, the controller 120 may perform the maintenance operation (dummy-discharge operation) for all the liquid discharge heads 119 (recording heads) when a condition of the maintenance operation for one liquid discharge head (recording head) is satisfied.

Further, the controller 120 may change the integrated value of the number of dummy-discharge operations according to whether the size of dummy-discharge liquid 116 is the "large droplet" or the "small droplet". For example, the controller 120 may use the integrated value of twice as large as the discharge operation of the "small droplet" for the discharge operation of the "large droplet". In other words, the controller 120 uses the integrated value of the discharge operation of the "small droplet" as half of the integrated value of the discharge operation of the "large droplet".

Further, the controller 120 may change the size of the dummy-discharge liquid 116 during the dummy-discharge operation according to the size of the discharged liquid in a previous discharge operation when the controller 120 controls to perform the dummy-discharge operation for the liquid discharge head 119 (recording head), the number of discharge operations of which exceeds a predetermined number of discharge operations. For example, the controller 120 uses "large droplet" during the dummy-discharge operations when the liquid discharge head 119 performs a large number of the discharge operations using the "large droplet".

Conversely, the controller 120 uses "small droplet" during the dummy-discharge operations when the liquid discharge head 119 performs a large number of the discharge operations using the "small droplet". In any case, the controller 120 may change variation of the dummy-discharge operation to effectively improve the discharge stability of the liquid discharge head 119 (recording head) and prevent clogging of the nozzles 130. Thus, the controller 120 can perform maintenance operation in a state close to the discharge operation for the image formation.

Figure 15:
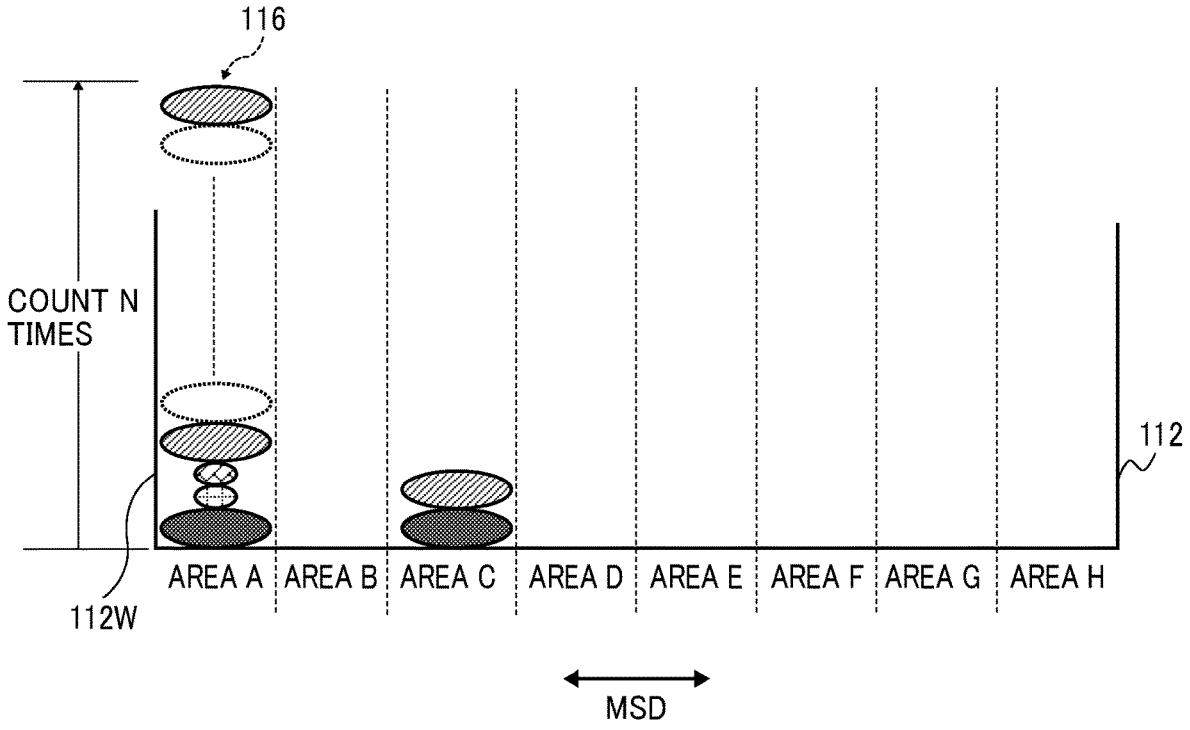
FIG. 15 is a schematic cross-sectional view of a dummy-discharge receptacle illustrating still another example of a state of accumulated dummy-discharge liquids by the dummy-discharge operation in the present embodiment.

Further, the controller 120 may change the size of the dummy-discharge liquids 116 during the dummy-discharge operation for every dummy-discharge operations. For example, as illustrated in FIG. 15, the number of the "small droplets" is counted as half of the number of the "large droplets". Thus, the controller 120 sets a coefficient of the "small droplet" to be smaller than a coefficient of the "large droplet" in counting the number of the dummy-discharge operations. Then, the printer 100 can perform further larger number of the dummy-discharge operations for one dummy-discharge area. Thus, the printer 100 can efficiently use the dummy-discharge receptacle 112 and reduce the amount liquids that becomes the dummy-discharge liquids 116 in the dummy-discharge receptacle 112.

[Functional Blocks of Controller 120]

Next, functional blocks of the controller 120 according to the present embodiment are described below.

Figure 16:
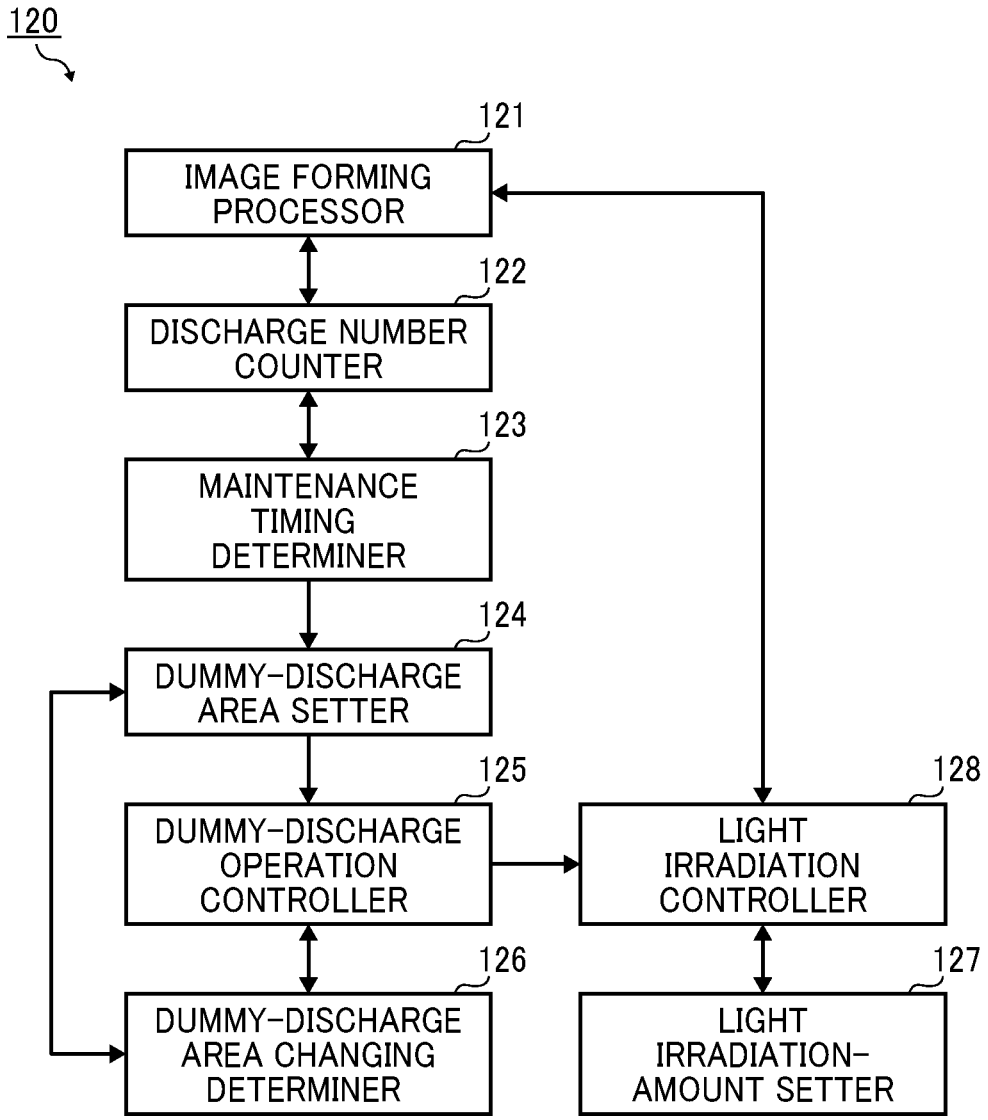
FIG. 16 is a functional block diagram of a controller that controls an operation of the printer.

As described above, the controller 120 is a computer that controls all operations of the printer 100 and a control software executed by using hardware resources of the computer to execute the functional blocks illustrated in FIG. 16.

As illustrated in FIG. 16, the controller 120 includes an image forming processor 121, a discharge number counter 122, a maintenance timing determiner 123, a dummy-discharge area setter 124, a dummy-discharge operation controller 125, a dummy-discharge area changing determiner 126, a light irradiation-amount setter 127, and a light irradiation controller 128.

The image forming processor 121 scans the carriage 102 in the main-scanning direction MSD and the sub-scanning direction SSD based on data (image forming data) input from outside the printer 100. The image forming processor 121 further controls the discharge operation of the liquid discharge head 119 of the head device 103 that discharges the curing liquid. That is, the image forming processor 121 drives the drive motor 111 to scan the carriage 102 in the main-scanning direction MSD and in the sub-scanning direction SSD based on the image forming data.

Further, the image forming processor 121 moves the head device 103 (liquid discharge head 119) to a predetermined position, sets the size of the discharge droplet and the number of discharge operations of the curing liquid to be discharged from the liquid discharge head 119, and controls the discharge operation of the liquid discharge head 119 based on the above-described setting. Further, the image forming processor 121 instructs the light irradiation controller 128 to irradiate the curing liquid discharged onto the stage 101 with the light such as ultraviolet rays.

The discharge number counter 122 counts the number of discharge operations in the image forming processor 121 and cumulatively adds the counted numbers of discharge operations to obtain an integrated value. The discharge number counter 122 calculates an integrated value of each of the liquid discharge heads 119 (recording heads) based on the number of discharge operations of each of the plurality of liquid discharge heads 119 (recording heads) and the size of liquid droplet discharged in each discharge operations. The integrated value is sequentially notified to the maintenance timing determiner 123.

The maintenance timing determiner 123 determines whether the integrated value notified from the discharge number counter 122 exceeds a predetermined threshold value as a condition to start the dummy-discharge operation. If the integrated value exceeds the predetermined threshold value, the maintenance timing determiner 123 starts the dummy-discharge operation. The maintenance timing determiner 123 may start the dummy-discharge operation for all liquid discharge heads 119 (recording heads) when the integrated value of a certain liquid discharge head 119 (recording head) exceeds the predetermined threshold value. Further, the maintenance timing determiner 123 may start the dummy-discharge operation for the liquid discharge head 119 (recording head), the integrated value of which exceeds the predetermined threshold value.

The dummy-discharge area setter 124 sets the dummy-discharge area according to a preset order, and notifies the dummy-discharge operation controller 125 of the dummy-discharge area set by the dummy-discharge area setter 124. Further, the dummy-discharge area setter 124 sets a new dummy-discharge area based on a notification from the dummy-discharge area changing determiner 126, and notifies the dummy-discharge operation controller 125 of the new dummy-discharge area set by the dummy-discharge area setter 124.

The dummy-discharge operation controller 125 performs the dummy-discharge operation on the notified dummy-discharge area, and counts a cumulative number of dummy-discharge operations during the dummy-discharge operation.

The dummy-discharge area changing determiner 126 determines whether a count result of the cumulative number of dummy-discharge operations in the dummy-discharge operation controller 125 equals or exceeds a preset first threshold value. If the dummy-discharge area changing determiner 126 determines that the count result of the cumulative number of dummy-discharge operations equals or exceeds the preset first threshold value, the dummy-discharge area changing determiner 126 instructs the dummy-discharge area setter 124 to change the dummy-discharge area.

The light irradiation-amount setter 127 sets an intensity of the light (ultraviolet rays) irradiated from the light irradiator 104 and a duration of irradiation of the light (ultraviolet rays) from the light irradiator 104.

The light irradiation controller 128 determines whether the count result in the dummy-discharge operation controller 125 is equal to or larger than a second threshold value that is a predetermined number of dummy-discharge operations. If the count result equals or exceeds the second threshold value, the light irradiator 104 irradiates a currently set dummy-discharge area with the light (ultraviolet rays) based on the setting set by the light irradiation-amount setter 127. Thus, the printer 100 can cure the dummy-discharge liquids 116 in a predetermined dummy-discharge area and can efficiently use the capacity of the dummy-discharge receptacle 112. The second threshold value is set smaller than the first threshold value.

[Process Flow of Dummy-Discharge Operation]

Next, a process flow of the dummy-discharge operation according to the present embodiment is described below with referring to FIG. 17.

Figure 17:
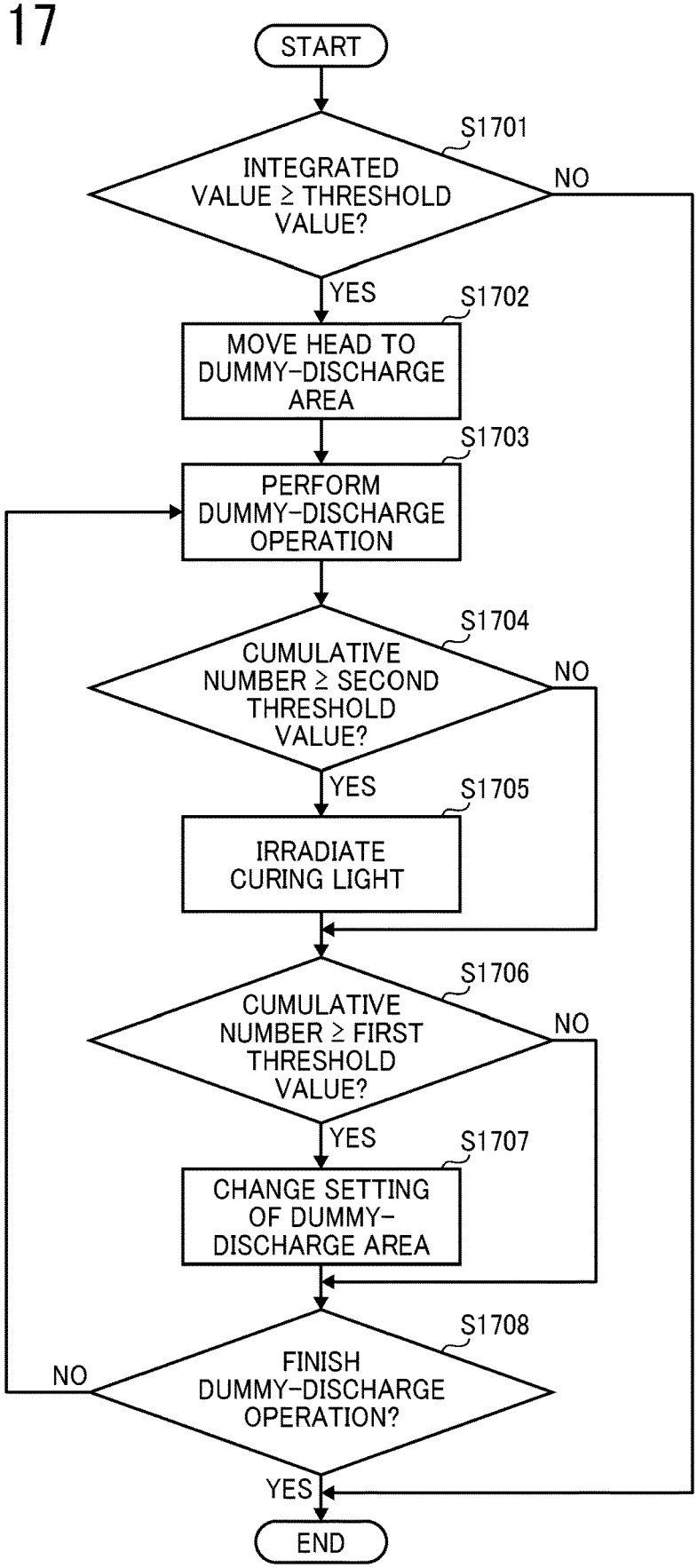
FIG. 17 is a flowchart of a flow of the dummy-discharge operation in the printer.

FIG. 17 is a flowchart of the dummy-discharge operation performed by the controller 120 including the above-described functional blocks. First, the maintenance timing determiner 123 determines whether the integrated value calculated by the image forming processor 121 and the discharge number counter 122 exceeds a predetermined threshold value (S1701). If the integrated value does not exceed the predetermined threshold value, the maintenance timing determiner 123 ends a determination process (S1701/NO).

If the integrated value exceeds the predetermined threshold value (S1701/YES), the dummy-discharge operation controller 125 starts the dummy-discharge process. First, the dummy-discharge operation controller 125 refers to the dummy-discharge area setter 124 and moves carriage 102 mounting the liquid discharge head 119 (recording head) in the main-scanning direction MSD toward the dummy-discharge area virtually set in the dummy-discharge receptacle 112 (S1702).

Next, the dummy-discharge operation controller 125 starts the dummy-discharge operation on the dummy-discharge area at which the liquid discharge head 119 faces (S1703). Here, the dummy-discharge operation controller 125 integrates the number of the dummy-discharge operations using any of variations described above for each time of the dummy-discharge operations. For example, the dummy-discharge operation controller 125 may calculate the cumulative number by integrating the number of the dummy-discharge operations for each liquid discharge head 119 and further multiplying integrated value with a coefficient based on the size of the dummy-discharge liquid 116 discharged during the dummy-discharge operation.

The information used for calculating the cumulative number in the step S1703 is information indicating a state of the liquid discharge operation for image formation. Further, the cumulative number calculated by the dummy-discharge operation controller 125 may indicate a number of the dummy-discharge operations actually performed. Further, the cumulative number calculated by the dummy-discharge operation controller 125 may be a value calculated using various coefficients so that the dummy-discharge operation is performable at an appropriate timing during the performance of the maintenance operation of the liquid discharge head 119 (recording head).

The dummy-discharge operation controller 125 updates the cumulative number for each dummy-discharge operations, and notifies an updated value to the dummy-discharge area changing determiner 126 and the light irradiation controller 128.

Next, the light irradiation controller 128 determines whether the cumulative number notified from the dummy-discharge operation controller 125 exceeds the second threshold value (S1704). If the cumulative number exceeds the second threshold value (S1704/YES), the light irradiator 104 irradiates the dummy-discharge liquid 116 with a light (curing light) such as ultraviolet rays (S1705). The second threshold value is also used as a threshold value to adjust an amount of irradiation according to a degree of curing of the dummy-discharge liquid 116. For example, the second threshold value may be set to radiate the light (ultraviolet rays) for each one dummy-discharge operation.

Further, the second threshold value may be set so that a next light irradiation is performed after a predetermined dummy-discharge operation that is performed after one light irradiation. Further, the second threshold value may be set to control timing of the next light irradiation according to elapsed time after performance of one light irradiation. If the cumulative number does not exceed the second threshold value (S1704/NO), the irradiation step (S1705) is omitted.

Next, the dummy-discharge area changing determiner 126 determines whether the cumulative number of dummy-discharge operations for the current dummy-discharge area exceeds the first threshold value using the various variations as described-above (S1706). Here, if the cumulative number of dummy-discharge operations on the dummy-discharge area exceeds the first threshold value (S1706/YES), the dummy-discharge area changing determiner 126 instructs the dummy-discharge area setter 124 to change and set the next dummy-discharge area according to a predetermined rule as described above.

Then, the dummy-discharge area changing determiner 126 notifies the dummy-discharge operation controller the next dummy-discharge area (S1707). If the cumulative number does not exceed the first threshold value (S1706/NO), the step of changing the dummy-discharge area (S1707) is omitted. A condition of "the cumulative number exceeds the first threshold value" in S1706 includes a condition of "the cumulative number of the dummy-discharge operation equals or exceeds the first threshold value". In other words, if the cumulative number of dummy-discharge operations is less than the first threshold value, the step of changing the dummy-discharge area (S1707) is omitted.

Next, the dummy-discharge operation controller 125 determines completion of the dummy-discharge operation (S1708). If the dummy-discharge operation controller 125 determines that it is not time to terminate the dummy-discharge operation (S1708/NO), the dummy-discharge operation controller 125 returns to the dummy-discharge operation (S1703). If the dummy-discharge operation controller 125 determines that it is time to terminate the dummy-discharge operation (S1708/YES), the dummy-discharge operation controller 125 ends the dummy-discharge operation.

The dummy-discharge operation controller 125 determines time to terminate the dummy-discharge operation according to various conditions, such as whether the dummy-discharge liquids 116 accumulated in the dummy-discharge receptacle 112 exceeds the capacity of the dummy-discharge receptacle 112, or whether the dummy-discharge operation has been performed a sufficient number of times as the maintenance operation, for example.

If the dummy-discharge operation controller 125 ends the dummy-discharge operation by a determination of the condition of the dummy-discharge liquids 116 accumulated in the dummy-discharge receptacle 112 exceeding the capacity of the dummy-discharge receptacle 112, the dummy-discharge operation controller 125 may notify and prompts replacement of the dummy-discharge receptacle 112.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

Each of the functions of the described embodiments performed by the controller 120 may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a liquid discharge head configured to discharge a liquid onto a medium;

a carriage mounting the liquid discharge head, configured to move the liquid discharge head in a main scanning direction;

a dummy-discharge receptacle configured to receive a dummy-discharge liquid discharged from the liquid discharge head in a dummy-discharge operation;

a light irradiator to irradiate the dummy-discharge liquid in the dummy-discharge receptacle with a light; and circuitry configured to:

set a plurality of dummy-discharge areas virtually dividing an interior of the dummy-discharge receptacle;

move the carriage in the main scanning direction to a first dummy-discharge area among the plurality of dummy-discharge areas;

drive the liquid discharge head to discharge the dummy-discharge liquid onto the first dummy-discharge area in the dummy-discharge receptacle;

irradiate the dummy-discharge liquid in the first dummy-discharge area in the dummy-discharge receptacle with the light;

determine whether a number of dummy-discharge operations exceeds a threshold value; and move the carriage to a second dummy-discharge area different from the first dummy-discharge area among the plurality of dummy-discharge areas if the number of dummy-discharge operations exceeds the threshold value.

2. The liquid discharge apparatus according to claim 1, wherein the circuitry is configured to irradiate the dummy-discharge liquid in the first dummy-discharge area in the dummy-discharge receptacle if the number of dummy-discharge operations exceeds another threshold value smaller than the threshold value.

3. The liquid discharge apparatus according to claim 2, wherein the circuitry is configured to set a coefficient of a first droplet of the dummy-discharge liquid to be smaller than a coefficient of a second droplet of the dummy-discharge liquid, a size of droplet of which is larger than a size of the first droplet, in counting the number of dummy-discharge operations.

4. The liquid discharge apparatus according to claim 1, wherein the circuitry is configured to set the threshold value according to a height of accumulated dummy-discharge liquids cured by the light.

5. The liquid discharge apparatus according to claim 4, wherein the dummy-discharge receptacle includes a side wall, and the circuitry is configured to set the threshold value to be higher than the side wall of the dummy-discharge receptacle.

6. The liquid discharge apparatus according to claim 4, wherein the circuitry is configured to form a partition wall to partition the interior of the dummy-discharge receptacle by the accumulated dummy-discharge liquids cured by the light.

7. The liquid discharge apparatus according to claim 1, wherein the circuitry is configured to set a size of each of the plurality of dummy-discharge areas according to a size of the dummy-discharge liquid cured by the light in the dummy-discharge receptacle.

8. The liquid discharge apparatus according to claim 1, wherein the plurality of dummy-discharge areas respectively accommodates a plurality of dummy-discharge liquids, including the dummy-discharge liquid, of respective colors.

9. The liquid discharge apparatus according to claim 1, wherein the second dummy-discharge area is separate from the first dummy-discharge area.

10. The liquid discharge apparatus according to claim 9, wherein the circuitry is configured to move the carriage to a third dummy-discharge area between the first dummy-discharge area and the second dummy-discharge area if the number of dummy-discharge operations exceeds the threshold value in each of the first dummy-discharge area and the second dummy-discharge area.

11. A liquid discharge apparatus according to claim 1, wherein the dummy-discharge receptacle is outside an area of the medium within a movable range of the carriage in the main scanning direction.

12. The liquid discharge apparatus according to claim 1, wherein the carriage mounts the light irradiator.

13. The liquid discharge apparatus according to claim 1, wherein the light irradiator is configured to irradiate the dummy-discharge liquid in the dummy-discharge receptacle with ultraviolet rays.

14. The liquid discharge apparatus according to claim 1, wherein the circuitry is configured to control a timing and an amount of irradiation of the light according to a degree of curing of the dummy-discharge liquid in each of the plurality of dummy-discharge areas.

15. The liquid discharge apparatus according to claim 1, wherein the circuitry is configured to perform the dummy-discharge operations according to information indicating a state of a liquid discharge operation of the liquid discharge head discharging the liquid onto the medium for image formation.

16. The liquid discharge apparatus according to claim 1, wherein the liquid is a curable liquid having a property of being cured by irradiation of a light having a specific wavelength; and the light irradiator includes an ultraviolet lamp configured to irradiate the liquid with the light having the specific wavelength.

17. The liquid discharge apparatus according to claim 1, further including a plurality of dummy-discharge receptacles for a plurality of types of dummy-discharge liquids, respectively, and the plurality of dummy-discharge receptacles includes the dummy-discharge receptacle, and the plurality of types of dummy-discharge liquids includes the dummy-discharge liquid.

18. A method for performing a dummy-discharge operation in a liquid discharge apparatus, the method comprising:

setting a plurality of dummy-discharge areas virtually dividing an interior of a dummy-discharge receptacle;

moving a carriage in a main scanning direction to a first dummy-discharge area among the plurality of dummy-discharge areas;

driving a liquid discharge head to discharge a dummy-discharge liquid onto the first dummy-discharge area in the dummy-discharge receptacle;

irradiating the dummy-discharge liquid in the first dummy-discharge area in the dummy-discharge receptacle with a light;

determining whether a number of dummy-discharge operations exceeds a threshold value; and moving the carriage to a second dummy-discharge area different from the first dummy-discharge area among the plurality of dummy-discharge areas if the number of dummy-discharge operations exceeds the threshold value.

* * * * *